US007429931B2

(12) United States Patent
Severson

(10) Patent No.: US 7,429,931 B2
(45) Date of Patent: Sep. 30, 2008

(54) PROXIMITY CONTROL OF ON-BOARD PROCESSOR-BASED MODEL TRAIN SOUND AND CONTROL SYSTEM

(76) Inventor: Frederick E. Severson, 3800 SW. Cedar Hills Blvd., Beaverton, OR (US) 97005

( * ) Notice: Subject to any disclaimer, the term of this patent is extended or adjusted under 35 U.S.C. 154(b) by 116 days.

(21) Appl. No.: 11/173,951

(22) Filed: Jun. 30, 2005

(65) Prior Publication Data

US 2006/0009117 A1 Jan. 12, 2006

Related U.S. Application Data

(60) Provisional application No. 60/585,890, filed on Jul. 6, 2004.

(51) Int. Cl.
*G08B 21/00* (2006.01)

(52) U.S. Cl. ..... 340/686.1; 104/296; 340/384.7; 446/410

(58) Field of Classification Search ..... 340/686.1 X, 340/933, 323 R, 988, 384.7; 104/296 Y; 446/409, 410, 454, 467; 318/280; 246/187 B, 246/122 A, 139; 701/2, 19; 702/150
See application file for complete search history.

(56) References Cited

U.S. PATENT DOCUMENTS 2,247,418 A * 7/1941 Smith ..... 246/31
4,914,431 A 4/1990 Severson et al.
5,174,216 A * 12/1992 Miller et al. ..... 104/296
5,267,318 A * 11/1993 Severson et al. ..... 704/270
5,448,142 A 9/1995 Severson et al.
5,555,815 A * 9/1996 Young et al. ..... 104/296
5,678,789 A * 10/1997 Pipich ..... 246/3
5,836,253 A * 11/1998 Kunka ..... 104/296
6,059,237 A * 5/2000 Choi ..... 246/192 A
6,883,758 B2 * 4/2005 Ruocchio ..... 246/193
7,028,955 B2 * 4/2006 Young et al. ..... 246/122 A
7,164,368 B1 * 1/2007 Ireland ..... 341/34
2004/0200935 A1 * 10/2004 Young et al. ..... 246/122 A

OTHER PUBLICATIONS

Model Railroad: English Dictionary, www-users.informatik.rwth-aachen.de/~wge/leisure/railroad/English.html, Jun. 10, 2005.

* cited by examiner

*Primary Examiner*—Brent Swarthout
(74) *Attorney, Agent, or Firm*—Stolowitz Ford Cowger LLP

(57) ABSTRACT

A model railroad remote object comprises a proximity detector, an on-board accessory, and an on-board processor. The proximity detector changes state based on proximity of the detector to a proximity source. The accessory, which is located on or within the remote object, exhibits a behavior based on a parameter. The processor, which is operatively connected to the proximity detector and the accessory, affects the value of the parameter of the accessory based on the state of the proximity detector. By way of illustration and not limitation, the on-board accessory may be an audio device, the behavior may be emission of sound, and the parameter may be sound volume.

19 Claims, 5 Drawing Sheets

PROXIMITY CONTROL OF ON-BOARD PROCESSOR-BASED MODEL TRAIN SOUND AND CONTROL SYSTEM

RELATED APPLICATIONS

This application claims priority under 35 U.S.C. § 119 to U.S. Provisional Application No. 60/585,890, filed Jul. 6, 2004, which is incorporated in its entirety herein by reference.

TECHNICAL FIELD

The field of this disclosure relates generally but not exclusively to model trains and more particularly to control of model train locomotives, rolling stock and accessories.

BACKGROUND

Most control of model railroading remote objects such as locomotives, rolling stock, etc. is done by sending remote control signals down the track or through the air. Both types of signal transmission can use analog or digital data. Examples of digital transmission include the National Model Railroad Association's standard Digital Command Control (DCC) that can be applied directly as a power signal on the track or radio transmitted through the air. There is currently very little control of the locomotive done through direct contact or through proximity detection.

Examples of direct contact control include volume adjustment of on-board sound systems, resetting microprocessors using a switch or jumper, selecting whether an on-board decoder is to be operated under DCC or Conventional Analog control, locking an engine into a direction state via Lionel's E-unit lockout, etc. There are a few examples of proximity control such as using a magnet to operate a latching switch in a model caboose, and magnets placed on model railroad track that trigger horn and/or bell sound effects when a locomotive passes over, but each of those controls operate one and only one effect as a simple on-off activation.

SUMMARY

In one respect, the invention is a model railroad remote object comprising a proximity detector, an on-board accessory, and an on-board processor. The proximity detector changes state based on proximity of the detector to a proximity source. The accessory, which is located on or within the remote object, exhibits a behavior based on a parameter. The processor, which is operatively connected to the proximity detector and the accessory, affects the value of the parameter of the accessory based on the state of the proximity detector. By way of illustration and not limitation, the on-board accessory may be an audio device, the behavior may be emission of sound, and the parameter may be sound volume.

In another respect, the invention is a combination comprising an external proximity source and a model railroad remote object having wheels for moving along a model railroad track. The remote object comprises an on-board processor that controls operation of one or more aspects of the remote object and a proximity detector located on or near the top side of the remote object such that the proximity detector detects whether the external proximity source is within a predetermined proximity of the proximity detector above or to the side of the remote object. The proximity detector has an output indicative of the presence of the proximity source within the predetermined proximity. The output is operatively connected to the processor, which affects operation of the remote object in response to receipt of a signal indicative of the presence of the proximity source within the predetermined proximity.

In another respect, the invention is a model railroading method, which detects the presence or absence of a proximity signal source within a proximity of a model railroad train remote object, sends an electrical signal to a processor in response to the detecting step, processes in response to receipt of the electrical signal to generate a command, and transmits the command to a controllable device on or within the model railroad train remote object, thereby causing the device to exhibit a desired behavior.

Additional details concerning the construction and operation of particular embodiments are set forth in the following sections with reference to the below-listed drawings.

DETAILED DESCRIPTION OF EMBODIMENTS

With reference to the above-listed drawings, this section describes particular embodiments and their detailed construction and operation.

What is generally disclosed herein is proximity control as a μP (microprocessor) input to change the settings of the on-board system or to control some feature operation normally reserved for remote control signals or manual manipulation. This proximity control eliminates the need to pick up and handle the locomotive or provide special openings in the engine body or take the locomotive cab off to access different controls. This allows richer control than simple on-off activation, such as selecting accessory parameters, selecting and/or activating a variety of effects using proximity means, using digital or analog data from proximity sources, or programming or operating a locomotive by proximity means. It also allows a large variety of different operations depending on the state of the remote object and/or on-board μP.

With the advent of walk-around throttles, more layouts are being designed that allow the operator to walk with his train as he moves around the room. Instead of a large remote control area, train operation is done locally by using manual turnout throws, local toggle switches for accessories, etc. Using movable or portable proximity signal sources that can be carried by the operator that can be applied as a signal source to model railroad locomotives, rolling stock and accessories is particularly useful for this approach to model railroading.

Figure 1:
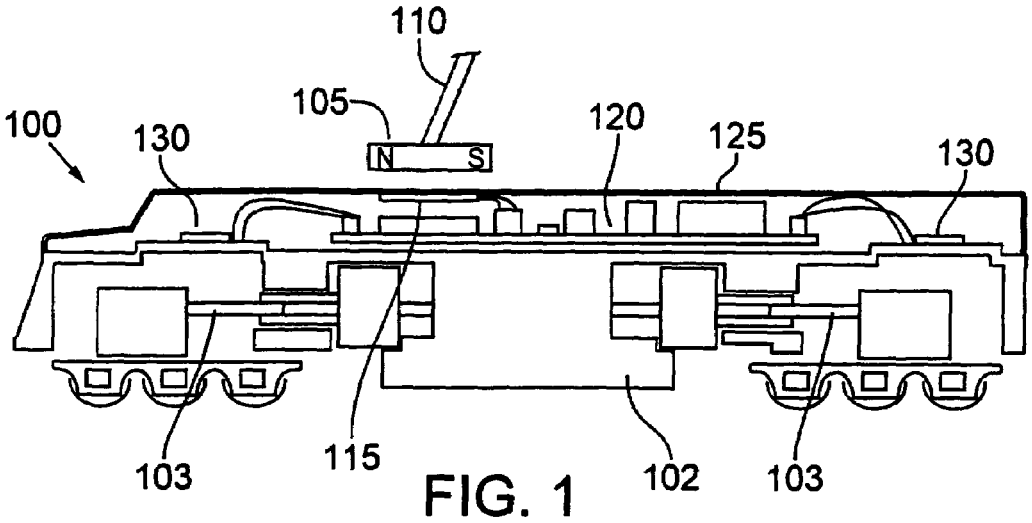
FIG. 1 is a cross-section diagram of a locomotive according to one embodiment.

An example of proximity control is shown in FIG. 1, which depicts a model railroad locomotive (sometimes referred to as an "engine") 100 having a motor 102 and drive train components 103. Here a magnet 105 at the end of a wand 110 is held close to a magnetic field sensor 115 at the top of the locomotive 100 to signal the presence of the magnet 105 to an on-board μP-based model train sound and control system (hereafter called "on-board μP system") 120. The locomotive's body 125 is preferably made of a non-ferrous material to allow the magnetic field to penetrate to the sensor 115. The magnetic field sensor 115 could be a reed switch or some other detector such as a Hall effect device. The sensor's input to the on-board μP system 120 could be used to change the volume of the sound system (including one or more speakers 130) such as increasing the volume incrementally as long as the magnet 105 is in close proximity or to incrementally decrease the volume if the magnet 105 is next removed and returned and held in close proximity. One advantage of this proximity detector method is that the operator does not need to remove the locomotive 100 from the track to operate a volume potentiometer on the bottom of the locomotive 100 or to open some access door to reveal the volume controls or to require more than one field sensor to do a plurality of operations, such as increasing the volume or decreasing the volume. In addition, the locomotive 100 can remain powered during this period so the operator can get immediate feedback on the condition of the volume adjustment. Since the locomotive 100 does not need to be handled, there is less chance of damaging some delicate detail parts or to have dirty hands in contact with the locomotive 100.

This locomotive 100 can take advantage of using the state of the μP and/or other μP inputs to activate different effects from the proximity source (e.g., the magnet 105). For instance, if the locomotive 100 is moving, the proximity of a magnet 105 may result in a brake squeal effect and/or the slowing and stopping of the locomotive, while if the locomotive 100 is stopped, it might produce a shut-down effect. Any locomotive 100 state may be used to change the effect of a proximity signal source such as the locomotive's speed, direction, starting up, shutting down, going forward or reverse, climbing a grade, the amount of track voltage, or any locomotive state enabled by a remote analog or DCC control signal.

Using the locomotive 100 of the engine to increase the number of remote control effects from a limited number of remote control signals is described in U.S. Pat. No. 4,914,431 but only with remote control rather than proximity control. As used herein, remote control signals are signals that are intended to affect a remote object from a relatively large distance; if the signal is transmitted, the remote object is affected. In contrast, a proximity source signal may be continually transmitted but will only be detected when the remote object is in close proximity to the proximity signal source. A remote object in the above patent was referred as an object that was separated in distance from the remote control signal sources. Here a remote object has a similar definition in that it can be located anywhere on a model train layout, but it is also characterized as an object that contains proximity signal detectors that can either be approached by a movable proximity signal source or can approach a fixed proximity signal source.

The above example of changing the volume with a magnet can utilize the state of the remote object (e.g., the locomotive 100) to increase the number of features or effects that can be controlled by a signal proximity signal source. In one state, for example, the presence of the magnet 105 incrementally increases the volume while in another state, the same magnet 105 decreases the volume. In other words, moving the magnet 105 away and returning the magnet 105 can have the effect of toggling the state of remote object between "enabled to allow volume increases" and "enabled to allow volume decreases."

This concept of using the state of the remote object to expand the number of affects can be expanded to control the volumes of different sound effects in a model train. For instance, a horn could be turned on and left on to produce a unique state. In the state of "horn blowing" the same magnet or other proximity signal source could incrementally increase or decrease the volume of the horn rather than change the state of the system volume. Or, if a bell sound effect were turned on instead of the horn, the same magnet could incrementally increase or decrease the bell volume without affecting the horn volume. In this way the operator could customize the volume of each individual sound effect and store these values in long-term memory. In a similar way, many different behavioral characteristics that would normally be programmed by remote control can now be programmed by a single proximity signal source.

Figure 2:
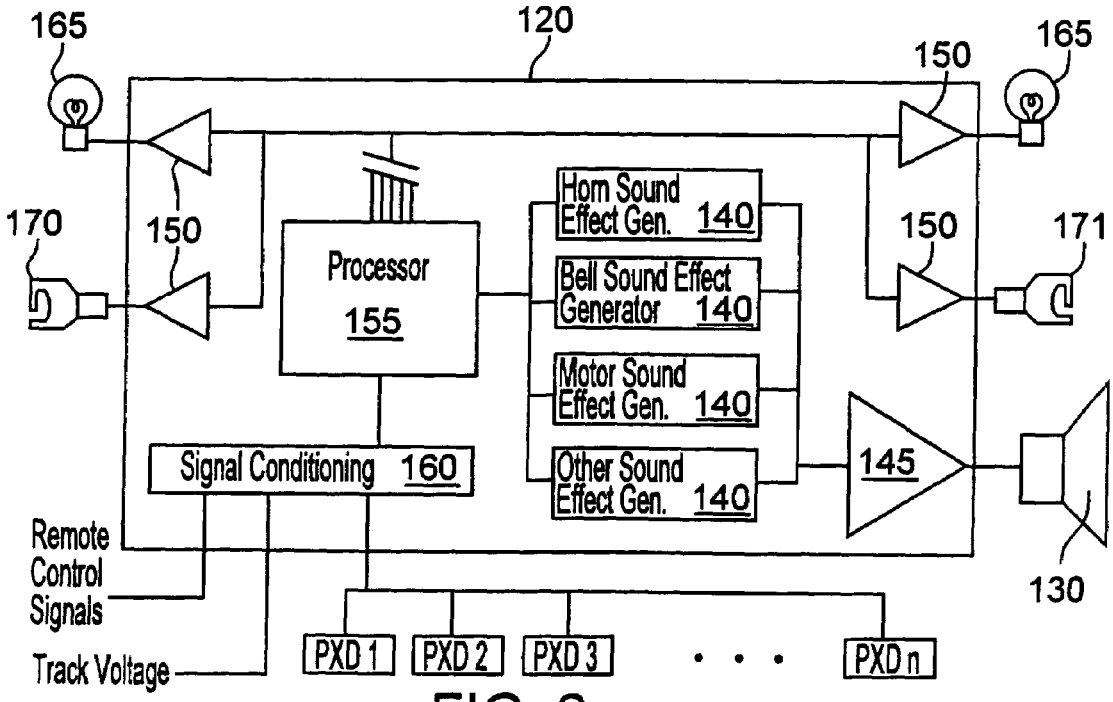
FIG. 2 is a general schematic diagram of the locomotive of FIG. 1.

A general schematic of one embodiment of the invention is shown in FIG. 2. Here the on-board system 120 is shown with internal sound effect generators 140 such as horns and bells, all of which are applied to an audio amplifier 145; lamp and coupler drivers 150; a processor 155 (such as a microprocessor) having state generator logic; and a component called "signal conditioning" 160, which insures that signals or data are properly modified to be acceptable as μP inputs. Also shown in FIG. 2 are a number of accessories such as lamps or other lights 165, couplers 170-171, speaker 130, etc. Inputs to the on-board μP system 120 include remote control signals such as DCC or analog control signals, track voltage, and inputs from n proximity signal detectors PXD1 through PXDn.

For this discussion, these detectors are called proximity signal detectors and the sources of the signals are called proximity signal sources. The type of proximity signal detectors are not specified. They can be any of a number of possibilities such as detectors for 1) magnetic fields, 2) magnetic north pole, 3) magnetic south pole, 3) electric charge (positive, negative or either) or electric field strength 4) heat, 5) infrared radiation, 7) audible sound source, 8) ultrasonic sound, 9) ambient light such as passing a shadow over a detector, 10) radio or an other EM radiation, 11) visible light, 12) chemical presence, 13) reflected sound waves or radio waves, 14) Doppler shift of radiated waves, 15) etc. Proximity signal detectors may be specifically designed to detect an individual type of proximity signal source or presence. Specific proximity signal sources are not shown in the figure. It is implied that if the on-board μP system 120 comes close to a proximity signal source and the appropriate proximity signal detector is enabled, a signal or data stream indicating its presence will be applied to the μP 155.

The double arrow between the signal conditioning component 160 and the proximity signal detector bus indicates that data or power may be supplied by the on-board μP system 120. The lines in FIG. 2 may be generally multi-line bus systems or data lines indicating that many effects besides those shown can be activated by the on-board μP system 120.

The μP 155 may also contain the components described in U.S. Pat. No. 4,914,431 to increase the number of remote control effects from the limited number of proximity or remote control signals available to the system. As described above, depending on the state retained in the μP 155, signals received from proximity detectors PXD1-PXDn via the signal-conditioning component 160 may generate different effects.

The type of proximity signal source may also carry other information besides its type of signal. It could be encoded with digital or analog information. For instance, a proximity source could be a modulated radio wave with digital information such as bit patterns. In this case, a detector PXD may receive the encoded source signal and deliver to the μP 155 the digital information or it may rely on the μP 155 software to interpret the signal. As an example, the proximity signal source may be human speech which is delivered to the μP 155 Analog to Digital (ADC) input directly from a microphone which would require speech recognition software to determine the meaning of the command.

One type of proximity signal source is direct touch where the operator actually touches the remote object. This method can utilize the same technology employed in light dimmers where the user touches a lamp any number of times to increase or decrease the light intensity. This technique may involve using the operator as an antenna or as a capacitor to couple charge from radiated household line current to a sensor directly by finger touch. In the case of a model train, the operator could touch some insulated metal part such as a decorative horn, that is connected to a touch plate detector connected to the μP 155.

In addition, moveable proximity signal sources may be applied and removed from a proximity signal detector to provide multiple hits or patterns of commands for complex functions. For instance, an operator may apply a movable proximity signal source near the proximity signal detector three times in quick succession to produce a different effect than for two times, or the operator may apply the proximity signal source with a pattern of long and short application periods.

Also, the proximity signal detectors may respond to the strength of the proximity signal source and provide an indication of the signal strength to the μP 155. Examples of proximity signal source strength would be light intensity, magnetic field strength, sound volume, etc.

Using a movable proximity signal source is advantageous when there are several remote objects involved that would normally respond to remote control signals. For instance, if a remote control signal for changing the volume affected by default all the engines in a consist (a group of locomotives coupled together and used in concert to provide more power for heavy train loads) and could not be specifically applied to any one locomotive, then the use of a movable proximity signal source could be applied to each locomotive separately to adjust volumes or other parameters individually.

The addition of feedback can be an enhancement, particularly if the state of the remote object is involved along with the proximity signal source. For instance, verbal feedback can indicate that a response has occurred and what effect was activated or it could indicate which state the remote object is in. In the above example of changing the volume of the remote object with the magnet, a model locomotive's horn effect could be heard sounding with each incremental increase or decrease of the volume. Other examples of feedback include flashing different engine lights or producing smoke from a smoke generator or have the engine move forward or backward, or hoot horns or ring bells, etc. An example of feedback indicating a distinct state could be an air let-off sound indicating the engine has entered a neutral state. The operator would then know that a moveable proximity signal source would have a different effect if subsequently applied to the proximity signal detector.

Figure 3:
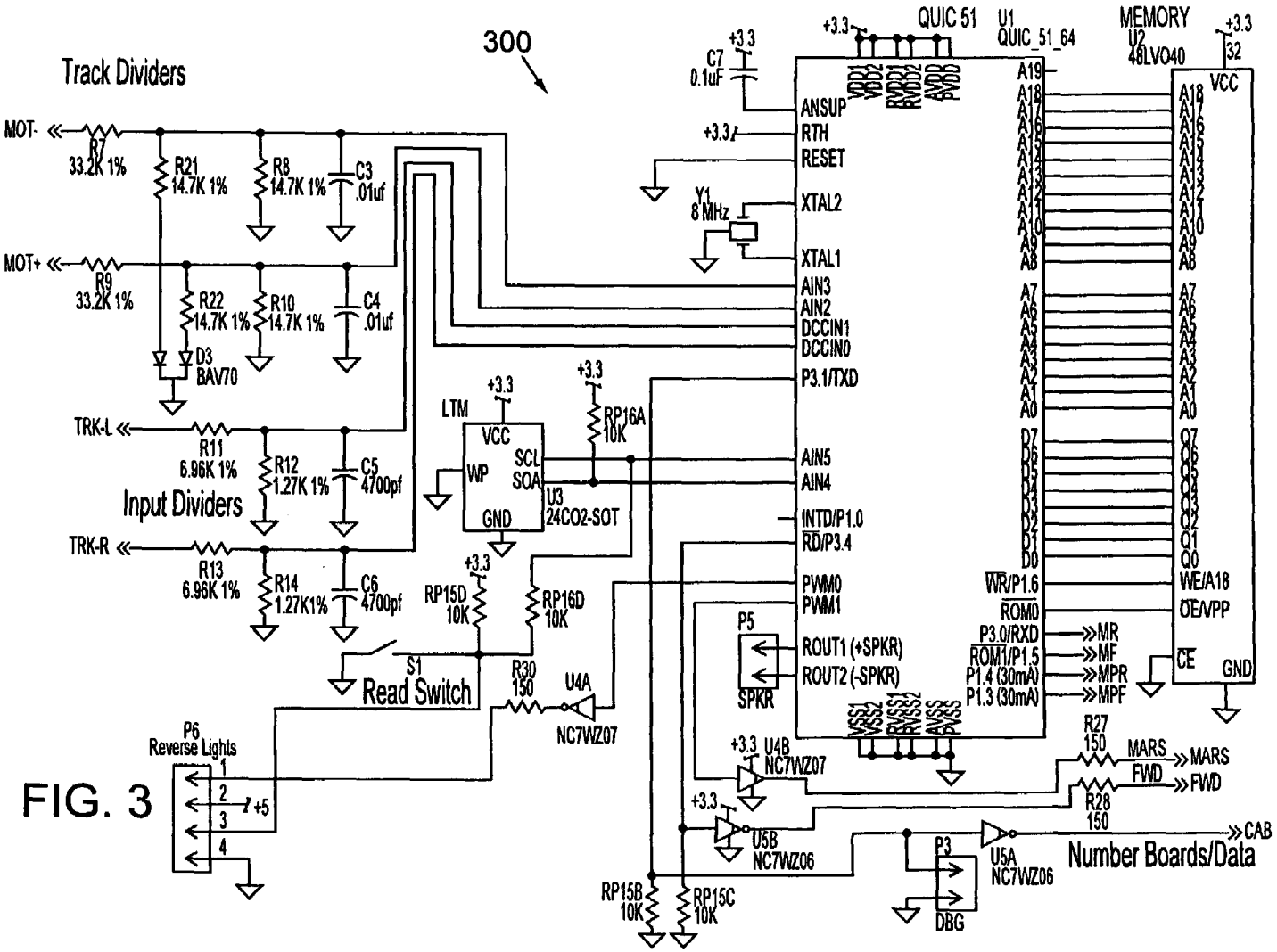
FIGS. 3 and 4 are electrical schematic diagrams according to various embodiments.
Figure 4:
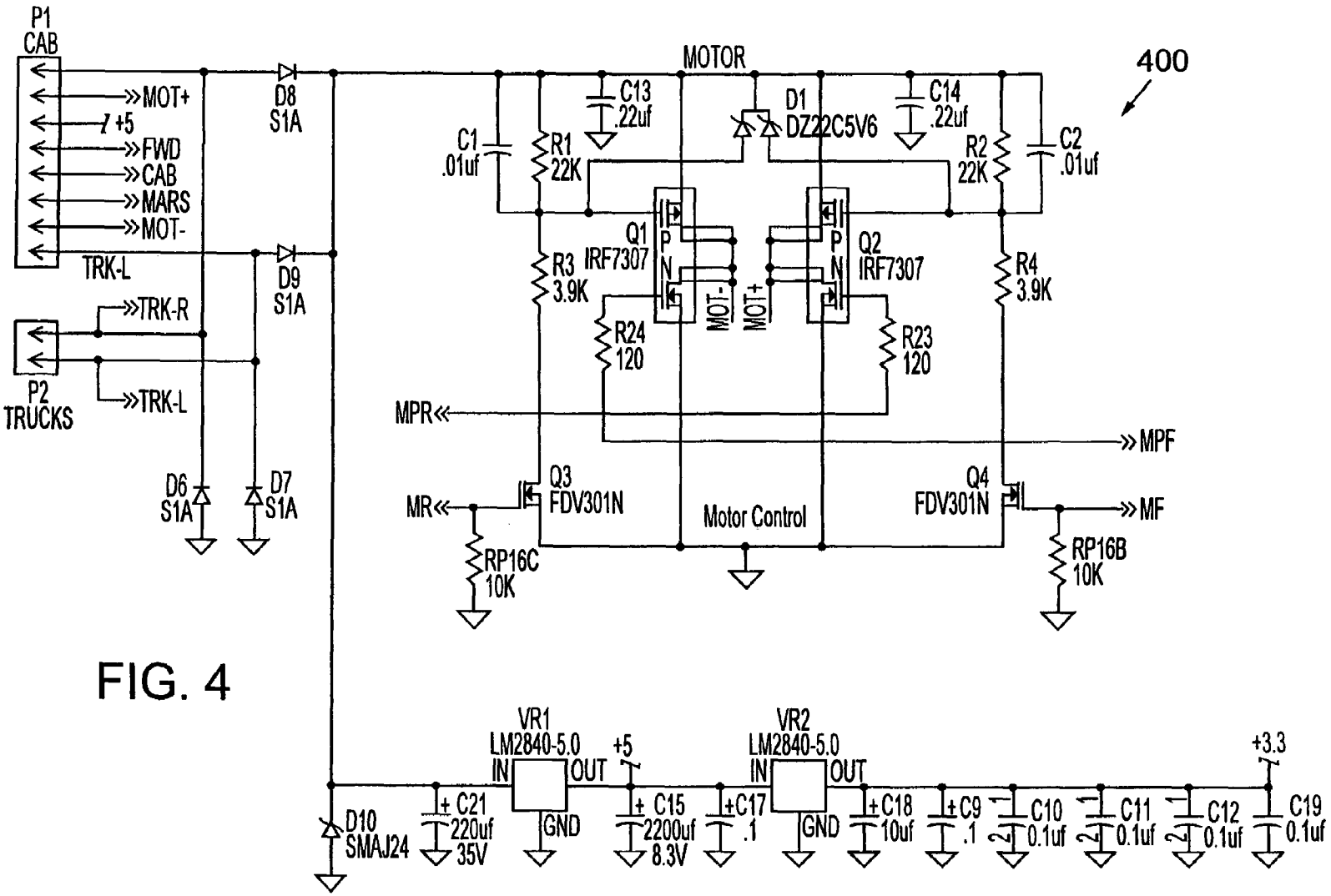

Full electrical schematic details of a specific embodiment are shown in FIG. 3 and FIG. 4. These two electrical schematics represent the design of a sound system for an HO steam locomotive using a special ASIC (application specific integrated circuit) QUIC 51 sound and train control chip available from QSIndustries, Inc., the assignee of the present invention. This product produces sound and train control under both conventional analog and digital command control. Analog and digital signal operation is described in U.S. Pat. No. 5,448,142.

When reed switch S1, in the circuitry 300 of FIG. 3, is in its normally open state, the input to QUIC 51 pin 16 is pulled high to VDD (3.3 volts) through the series combination of 10K resistor RP15D and 10K resistor RP16D. When the reed switch S1 is closed by the proximity of a magnet, the input to QUIC 51 pin 16 is pulled low though 10K resistor RP16D. Pin 16 of the QUIC-51 can be shared with both reed switch circuitry and the long term memory clock line to save an I/O (input/output) pin, but the reed switch circuit could as easily be connected to any other available ADC (analog-to-digital conversion) pin. The reed switch S1 can be used to do a number of operations when activated by the proximity of a movable magnet that will be manipulated by the operator at times during normal operation of his model locomotive.

FIG. 3 includes resistor dividers for reducing the magnitude of the applied track voltage by a predetermined amount to apply to the QUIC 51 ADC inputs. One divider connected to the left model train rail, TRK-L, is made up of resistors R11 and R12 giving a voltage reduction of R12/(R11+R12) which is applied to ADC input DCCIN1. A second divider connected to the right model train rail, TRK-R, is made up of resistors R13 and R14 giving a voltage reduction of R14/(R13+R14) which is applied to ADC input DCCIN0. Capacitors C5 and C6 are connected directly across these two ADC inputs to reduce track or motor electrical noise. QUIC-51 inputs are internally connected to a DCC detector that was designed to efficiently and accurately extract the serial digital information included in the NMRA DCC power and control track signals when the locomotive is under command control. Under analog control, QUIC-51 analyzes the waveforms detected by the two ADC inputs to determine the amount of voltage applied between the two rails, TRK-1 and TRK-2, and any other analog signals or digital data or commands that may also be impressed on the track.

FIG. 3 also utilizes resistor dividers to sense on-board electric motor voltage. This is primarily used to measure the back EMF (electromotive force) component from the DC motor when QUIC-51 shuts off the applied motor power. Back EMF is directly related to rotational speed of the electric motor. From the Back EMF spec. for the motor, gear ratios and size of the locomotive drive wheels, a determination can be made of the locomotive's scale speed.

The resistor dividers are designed to provide less attenuation of low voltage values of back EMF to increase the accuracy of these measurements when the locomotive is moving at a slow rate. For instance, a low voltage applied to the divider made up of R7, R8 and R21 will produce a voltage attenuation of R8/(R7+R8) as long as this voltage is not above the turn on voltage of diode D3. If high motor voltage is applied to this divider, the attenuation is approximately (R8+R21)/(R8+R21+R7) except for the slight error caused by the forward voltage drop of diode D3. For the values of resistors shown in FIG. 3 where R8 equals R21, the attenuation is reduced by a factor of two for low motor voltage than for high motor voltage. The output from this divider is applied to QUIC-51 ADC input AIN3. Capacitor C3 is connected directly across AIN3 input to reduce track or motor electrical noise that could adversely affect the back EMF or other motor voltage measurements. The second divider network made up of R9, R22, R10 and C4 performs the same function for the other motor contact. The output from this divider is connected to QUIC-51 ADC input AIN2.

QUIC-51 analyzes the waveforms detected by the two ADC inputs, AIN2 and AIN3 to determine the amount of voltage applied between the two motor terminals, MOT− and MOT+, and any other analog signals or digital data or commands that may also be impressed on the motor voltage and determine the back EMF generated by the spinning motor when power is shut off to the motor. The transfer functions for these dividers can easily be determined and internal calculations performed by QUCI-51 to provide accurate values for motor voltage and back EMF.

Integrated circuits U4A, U4B, U5A and U5B provide output drivers for lights or other accessories under QUIC-51 control. U5A can also be used for serial output data. Memory U2 contains QUIC-51 operation code and sound data files. QUIC-51 ROUT1 and ROUT2 connect the internal audio amplifier to on-board speakers for sound production.

FIG. 4 shows a power supply and motor drive circuitry 400. DC power is supplied by a full wave bridge with inputs connected to track inputs, TRK-R and TRK-L, and made up of diodes D6, D7, D8 and D9. This rectifier bridge supplies raw DC voltage for both the on-board electronic DC power supply and the motor drive circuit. Capacitor C21 is a filter cap that reduces ripple and noise.

The motor drive circuitry 400 is a bridge design with high-current FET (field effect transistor) p-channel/n-channel pairs, Q1 and Q2. The motor is enabled to rotate in one direction when p-channel FET Q1 and n-channel FET Q2 are on and n-channel FET Q1 and p-channel FET Q2 are off. The motor is enabled to rotate in the opposite direction when p-channel FET Q2 and n-channel FET Q1 are on and p-channel FET Q1 and n-channel FET Q2 are off. The gates of n-channel FET Q1 and n-channel FET Q2 are directly controlled through 120 ohm resistors by QUIC-51 PWM (Pulse Width Modulated) outputs, P3.0/RXD and ROM1/P1.5. The duty cycle of the PWM output changes the amount of power applied to the motor. The gates of p-channel FET Q1 and p-channel FET Q2 are controlled by the drain outputs from Q3 and Q4. If Q3 and Q4 are off, p-channel FET Q1 and p-channel FET Q2 are held off by gate pull-up resistors R1 and R2. If Q3 is on, negative gate voltage is applied through divider R1 and R3, turning on p-channel FET Q1. If Q4 is on, negative gate voltage is applied through divider R2 and R4, turning on p-channel FET Q2. Capacitors C1 and C2 are included to limit motor or track noise from affecting the gates of p-channel FET Q1 and p-channel FET Q2. Zener diodes D1 are each connected from the gates of p-channel FET's Q1 and Q2 to +DC to prevent excessive gate voltage from damaging these parts when either Q3 or Q4 is on and high track voltage is applied.

The electronic power supply is a two stage design. The +5 volt regulator, VR1, supplies voltage to the second filter capacitor, C15, and a second linear regulator, VR2, supplies a steady 3.3 volts for the main system microprocessor, and other electronic components, which includes ROM (read only memory), LTM (long term memory), light drivers, and all other components requiring electronic 3.3 volt power.

While the voltage rating of capacitor C21 must accept the peak operating track voltage between TRK1 and TRK2, capacitor C15 only needs to be rated at 5 volts. The two-stage design allows C15 to have a much higher capacitive rating and much lower voltage rating than C21 without requiring large physical space. This provides a robust 3.3 volt supply with reduced ripple for operating at low track voltage and maintains stable power during brief interruptions in power from poor track pickups, or opens or shorts that may occur from faulty track, turnouts, derailments, etc.

The power supply circuit in FIG. 4 is design to provide stable voltage for DCC where the track voltage is constant at a high value (14 to 40 volts depending on scale and power supply) and for Analog where the track voltage can be reduced to low voltages in the 2-5 volt range, where it is difficult to generate sufficient voltage for on-board electronic circuits. Analog operation benefits from reducing insertion loss for various components to a minimum; diodes D6 through D9 can be Schottky types which have forward turn-on voltages that are usually 0.3 volts less than p-n diodes and the +5, and +3.3 volt regulators, can be low drop out (LDO) types. Capacitors C17, C9, C10, C11, C12 and C13 are preferably high frequency 0.1 uf capacitors distributed at various locations and components throughout the 3.3-volt power supply grid to by-pass electrical noise. Diode D10 is a surge suppressor to prevent over-voltage conditions from damaging capacitor C21 and other electronic components.

Figure 5:
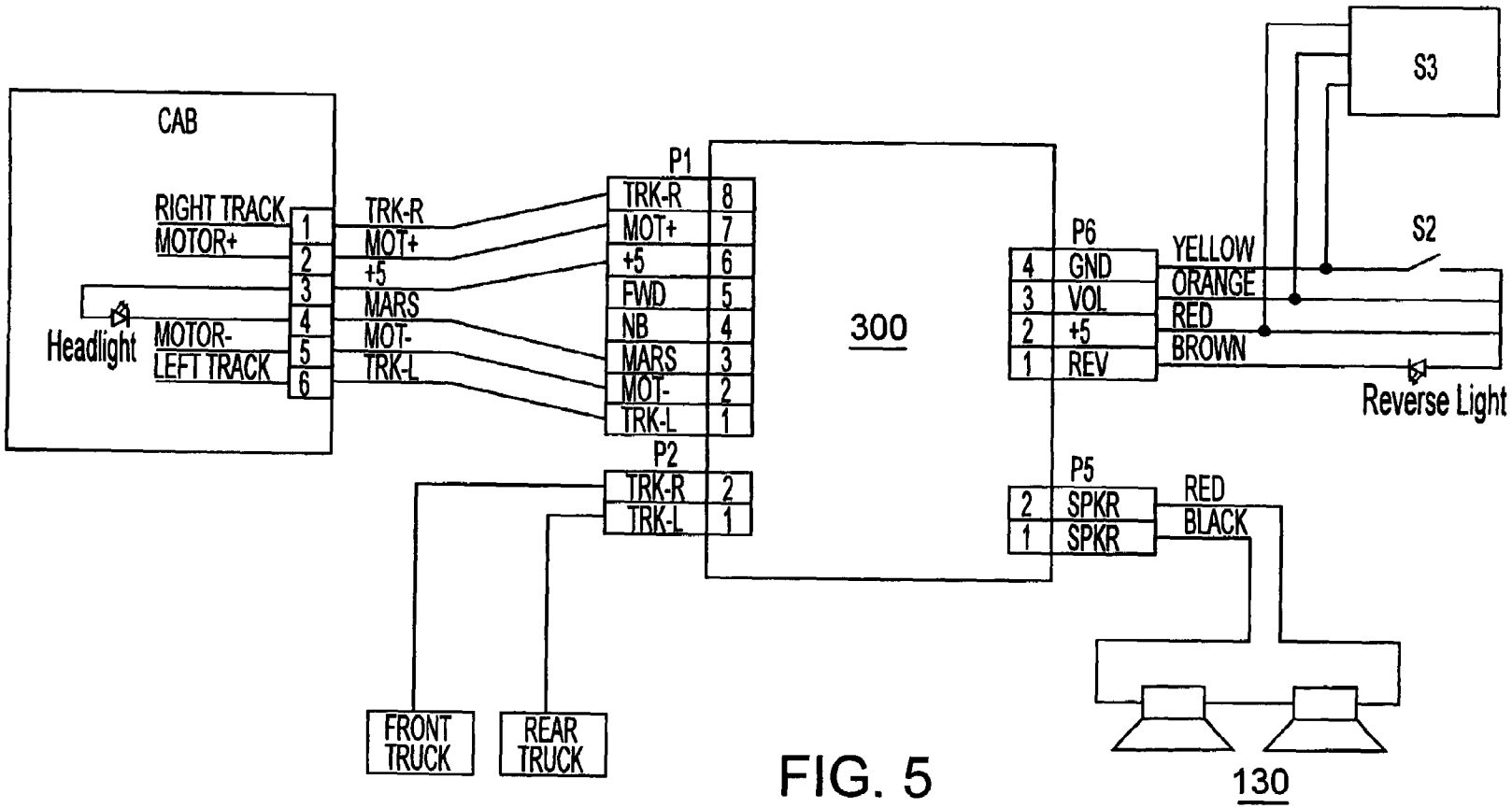
FIGS. 5 and 6 are wiring diagrams according to various embodiments.

FIG. 5 is a wiring diagram for the circuitry 300 in a locomotive. FIG. 5 shows the use of either an optional reed switch S2 magnetic proximity detector or an optional Hall effect sensor S3. The Hall Effect sensor S3 is also shown connected to a +5 volt power line supplied by the system.

Figure 6:
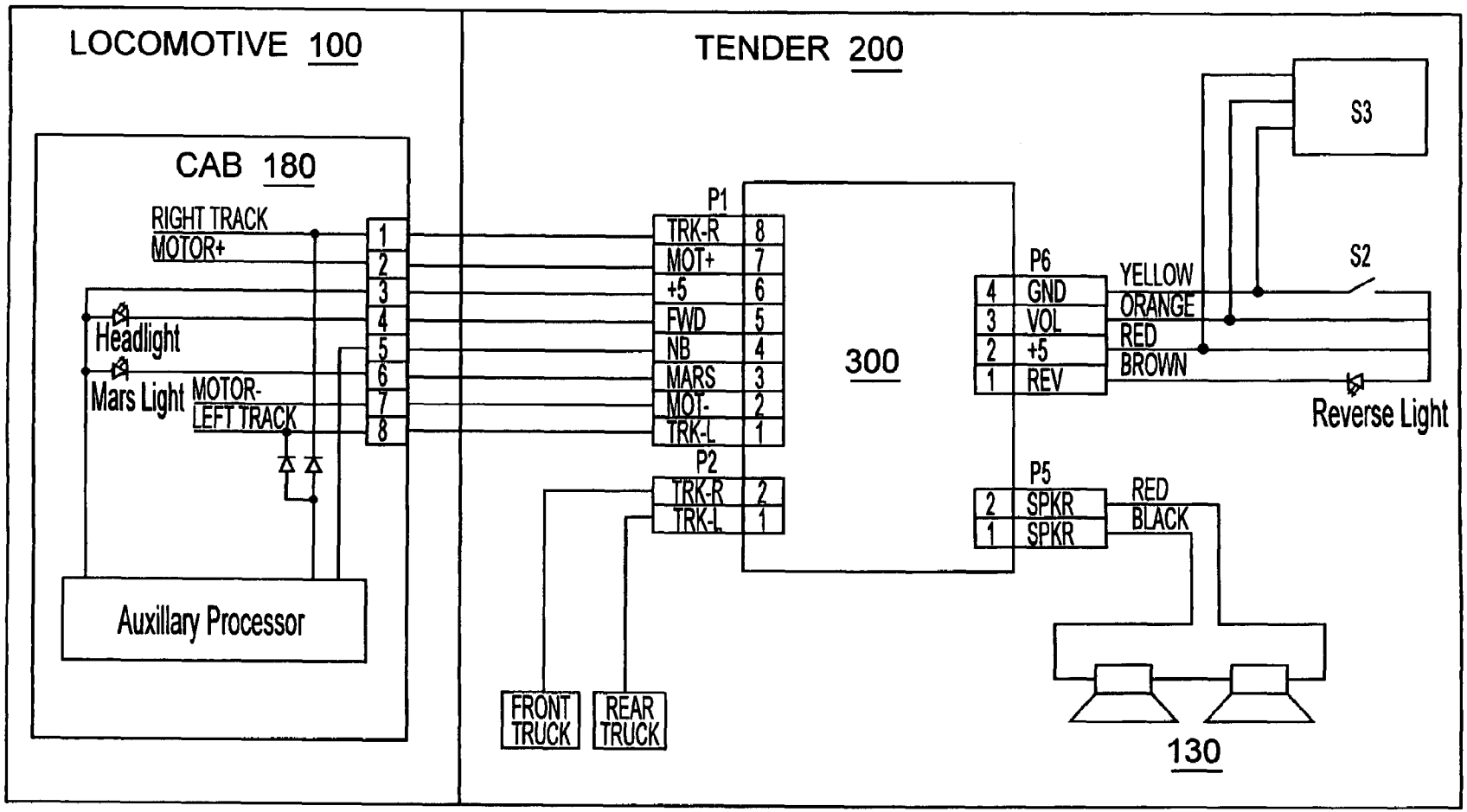

FIG. 6 shows the same optional reed and Hall effect detectors in another architecture where an additional μP-based component is included in the locomotive 100. Generally, the on-board μP system 120 is housed in a tender 200 for a locomotive 100, as the tender 200 may provide more room to house circuitry and accessories. However, since there may be a considerable number of effects and states associated with the locomotive 100, an additional μP cab system 180 is preferably included to reduce the number of feature control lines that would normally connect between the locomotive 100 and the tender 200. Pin 4 on P1 is a data line that can be used to detect new states or control features via the cab on-board IμP system 180 or to respond to proximity detectors within the locomotive 100 (as opposed to the tender 200).

In light of the teachings set forth herein, those skilled in the art will appreciate many diverse and valuable applications to which the various disclosed embodiments can be put. What follows is a discussion of a sample of illustrative applications.

Independent operation of model train couplers: FIG. 2 shows a locomotive with both an operational front coupler 170 and reverse coupler 171. Proximity detectors placed at each end of the locomotive would allow the operator to place a portable proximity signal source at one end of the train or the other to control each coupler independently. Or one proximity detector could be used on the engine to open either coupler depending on which direction the engine is moving or had recently moved. Rolling stock could also have an on-board μP system to operate the car couplers with a portable proximity signal source. Individual couplers can also be opened or closed by activating a fixed proximity signal source to convey analog or digital commands to an on-board proximity detector.

System volume control and independent control of sound effects: As described above, a magnetic detector can be used to change both the volume of the on-board μP system or the volume of individual sound sources. The state of the system would change whenever an individual sound is activated to direct the proximity signal source to affect only that feature. Although a single magnet detector was described for volume control, any number of proximity signal sources could be used such as light, or polarity sensitive magnetic detectors. For instance, some magnetic detectors respond differently to the direction of the magnetic flux. A north pole in proximity to such a detector could increase the volume while a south pole in proximity could decrease the volume or vice versa. Also some detectors respond to how close the proximity signal source is to the detector. This would allow a design that could respond with continual volume changes as the magnetic field or light intensity is increased or decreased.

Reset the remote object to factory default values: If a locomotive or remote object with an on-board μP has become non-responsive to remote control signals or has been programmed by the user that has resulted in undesirable or confusing behavior, the operator can reset his locomotive or remote object to original factor default conditions by placing a proximity signal source next to the appropriate proximity signal detector in the locomotive. The locomotive could respond to this reset operation with a horn hoot or perhaps the verbal response "reset." If the proximity signal source is also used for other effects, then the state of the locomotive could be changed to provide the reset effect. One method is to turn off the track power, then place the proximity signal source next to the proximity signal detector and then turn the power back on. The special state of "locomotive recently powered up" along with the proximity signal detector activated would result in a reset operation.

Selecting or deselecting locomotives, operating rolling stock items, or accessories: Locomotives, rolling stock or other remote objects could be selected or activated by placing a movable proximity signal source next to locomotive's or remote object's proximity signal detectors. For instance, engines that are shut down or deselected can be activated, or engines that are activated can be shut down. This allows specific locomotives to be selected or deselected without the need of a block control system common to conventional or analog control model railroad layouts. Locomotive consists could also be made up one locomotive at a time and then once the consist is made up, an operator can select each locomotive to be activated so, for example, all engines in the consist would be powered at once.

Helper types activated for each locomotive in a consist: A movable or portable proximity signal source could be used on each locomotive in a consist to select the type of helper such as a lead engine, a mid consist helper, or an end helper, pusher type or normal locomotive. Lead engines have operable horn, bells while other helper types do not. Also lead engines usually have lights, while mid engines do not and pushers or end engines have operable reverse lights. Again, the state of the locomotive may be altered to accept helper type changes where the same movable proximity signal source would otherwise have a different effect.

Coupler crash sound effects: Proximity signal source can be placed on rolling stock and other locomotives to cause a coupler crash sound when activated. Alternately, the crash sound could occur automatically whenever an open coupler is closed. To prevent false operations, the two methods can be combined so that the crash sound occurred only if the open coupler knuckle closed and the proximity of rolling stock or engines was detected. Also, closing a coupler under such conditions could activate inertia effects that limit acceleration when the train pulls out with its load of cars.

Status reports: Verbal status reports could be activated using a movable or stationary proximity signal source. For instance, a consist or train passing over a proximity signal source could report on the condition of each engine, its helper type, how much fuel it has, it speed, etc. or a movable or portable proximity signal source could be used to activate a status report in each engine, one at a time. Or a status report enable signal might be sent to a group of engines to create a special on-board state to allow a movable proximity signal to activate a status report when applied to each locomotive where the same movable proximity signal source would otherwise have a different effect.

Brake squeal triggered by fixed proximity source: Brake squeal on prototype railroads usually occurs where the track curves and the wheel flanges tend to rub against the rails. A fixed proximity source such as magnets can be placed in curved track area to trigger flange squeal effects in each locomotive that have proximity signal detectors mounted under the locomotive. Alternately, proximity detectors could be mounted in the curve to trigger stationary sound effects in a trackside sound system when proximity signal sources are detected in the moving train.

Turning on or off locomotive appliances: Most model trains are too small to operate any of the hand valves or other levers. In addition, it is difficult to design very small mechanical apparatus that actually works or works without breaking when the operator can apply enormous force in proportion to the size of the controls on a model. However, touch control or a small light beam like a laser, or magnet or any other non-invasive proximity signals can be a solution for operating different locomotive appliances individually. The appliances could be activated by a proximity source near their model control levers and valves or the appliances itself could be activated by proximity control. This could expand the fun of operating model trains where normally the operator only interacts with his train from a distance with remote control signals. If the operator could turn on his steam generator with the touch of a finger or turn off his lights, move the reverse lever by touch, or open front and rear couplers by touching the lift bars, model railroading would have a more visceral impact on the operator. Steam engines are ideal for this type of control since most steam appliances are on the outside of the engine where they can be touched. However, diesels also have overhead blinking lights, couplers, front and rear lights, truck lights, porch or step lights, or the like, which could be controlled by a touch or proximity source.

Trackside accessories as proximity sources: Trackside accessories can also activate certain on-board effects by proximity control. For instance, a trackside water tank could have a proximity signal source in the waterspout such that when the spout in lowered into the tender water fill hatch, it activates a proximity signal detector in the tender to produce water filling sound effects that would then automatically shut off when the spout is removed or a bi-directional signal is sent from the tender indicating that it is filled with simulated water. Also, opening and closing hatches could produce sound effects of metal against metal and creaking hinges when opened by hand. Fuel loading could also produce appropriate sound effects when fuel fillers are inserted by hand into the model and steam engine lubrication sound effects could also be produced when air hoses are attached.

Clickity-clack sound effects: Another interesting effect is a clickity-clack sound whenever heavy wheels pass over track joints by using a proximity detector at the track joint that could detect the presence of each wheel.

Smoke generators: Other items that could be operated by touch include steam or diesel engine smoke generators. Also the amount of smoke could be dependent on the amount of time the smoke generator was touched or how long the proximity source signal was present. Since smoke generators can get hot to the touch, another type of proximity signal source might be considered such as a light beam. Additional appliances that could be controlled by direct touch or proximity control are steam engine blow down, water injection, coal loading from trackside accessory, on-board coal auger, pop-off or "safeties", water pumps, blower hiss, coal shoveling sounds, truck lights, cab lights, etc. Other diesel appliances include overhead fans, windshield wipers, dynamic brakes, engine room light, and diesel cab doors.

Voice commands: Another type of proximity control for engines may be voice commands. Although a loud voice may register across a large distance, a softly spoken voice command spoken near and directed at a remote object can be effective over just a proximate distance. This would allow the operator to interact with the imaginary crew directly. He could speak orders close to an engine that would command the crew to operate lights and other specific appliances. He could also place a handheld proximity source close to the locomotive he wishes to address which would select only that locomotive to receive voice commands. Since it is difficult to develop software that recognizes all the different kinds of speech patterns, specific speech could be produced from a handheld control box where commands are already recorded and easy recognized by the on-board μP system. Pressing a button on such a handheld to start up the steam generator would produce a spoken phase like "fire up the dynamo" that would be repeatable and easily understood by the speech recognition software and by the operator. The handheld could also simply send encoded digital commands via a proximity signal source to the appropriate locomotive's proximity signal detector. The operator might press a button on the handheld to turn on the overhead blinking lights and only select the lead and the end engine to receive this command by only applying the proximity signal source to these specific engines. This digital command could also be accompanied by the same command spoken verbally just to add to the fun and as valuable feedback.

Progressive doppler shift: Another application of proximity control is a progressive Doppler shift effect. Doppler shift effects for model trains are described in U.S. Pat. No. 5,896,017, in which on-board sounds effects in a train change frequency and volume as a function of scale speed to simulate the effect of a moving sound source passing by an observer. Usually this effect is triggered in a model locomotive by a remote control command that is timed to have the Doppler effect occur in front of an observer watching the model train pass by. For a train that contains a number of sound producing sources at different locations within the train, it would be much better to have the Doppler effect for each sound source occur in front of an observer as each source passes by instead of having all sound sources in the entire train produce this effect simultaneously. A progressive Doppler effect could be created by a proximity signal source located at a specific location, like a highway grade crossing, where an observer is likely to watch the model train go by. This would allow each individual sound system in the train to react to the proximity source in turn. For example, consider a progressive Doppler command sent to a train approaching a proximity signal, source where the train had a lead consist of two locomotives, followed by a number of cars and a mid-train helper engine followed by more cars and finally after the caboose, a pusher locomotive. As soon as the progressive Doppler command was sent, the on-board sounds for all locomotives could shift gradually and hopefully unnoticed upwards to a higher frequency that was based on the expected Doppler frequency for a sound source moving towards an observer at the model train's scale speed. This sets the stage for the Doppler shift effect. As the first locomotive proximity detector senses the stationary proximity source, it initiates a Doppler shift scenario where the frequency shifts from the higher approaching Doppler frequency to a lower Doppler frequency based on the engine moving away at its scale speed. In addition, the Doppler scenario would have produced a rapid increase in volume as the engine approached followed by a rapid decease in volume as the train passed, all based on the scale speed. The second engine in the lead consist would go through the same scenario but it would be delayed in time since it would reach the proximity source a little later. After a number of cars had passed, the mid train helper would finally reach the proximity source and produce its own Doppler shift and finally as the end of the train reached the proximity source, the pusher locomotive would execute its Doppler shift effect. By this time all locomotives in the train would be at the lower Doppler shift frequency and receding from the observer. A second remote control command sent to the train could return all locomotive sound systems gradually and hopefully unnoticed to their original non-Doppler shifted state. During this Doppler effect, the observer has the experience that the engine that had passed him by would be lower in frequency while engines that are approaching would be shifted higher in frequency, producing a very realistic effect. If rolling stock in this train are equipped with such sound systems, they would each go through a Doppler effect as they sensed the proximity source. Sound effects in cars could include clickity-clack wheel sounds and groans and creaks common to rail cars. An occasional car with a flat wheel thump-thump sound could also Doppler shift—a familiar sound heard by almost every railroad enthusiast who carefully listens to trains pass by.

Communication between cars: Communication between cars, locomotives and trackside transceivers is also possible. In model railroading, like prototype railroading, it is important to have information about the cars identity, its contents, value, its owner, and destination and the real or simulated condition of the car and, of course, the location of the car on the layout. Some of this information could be transmitted via bidirectional communication back to the controller but it may need to be queried on a car-by-car basis or the continual flow of such information from all cars could overburden the communication system. In particular, car location is not known directly by the car. One solution to the this problem is to use "Car Transceivers" located under each car, or "Locomotive Transceivers" located under each locomotive, perhaps at each end, to transmit information to fixed "Track Transceivers" located in the track or at trackside. Information could include the status, ID number, etc., which would also locate the car or locomotive on the layout. Track Transceivers could also communicate to the car or locomotive information about its location within the train which would be stored in the remote objects LTM, each car or locomotive being given progressive train location ID numbers as they passed the track transceivers. The last car and the "Track Transceiver" would both know that is was the last car and how many cars were in the train. Present LED (light emitting diode) technology is favored for the Car Transceivers and Track Transceivers. A modulated IR (infrared) carrier to transmit information would also be prudent to minimize ambient IR from sending false data.

Another interesting application of proximity transceivers is signal transmission from car-to-car, car-to-locomotive and locomotive-to-locomotive: Bi-directional communication on the track rails from the locomotives or the cars cannot give information about where within a train a particular car is located, or how many cars are in a train, or which way individual cars are aligned. Progressive car detection and identification either from car-to-car transmission or track transceivers could provide each car with a position number and direction and the last position number would indicate the number of cars. Car-to-car communication could be done by using LED proximity transceivers located at the end of each car or locomotive and aligned parallel to the track rails and directed towards each other, preferable out of sight like under the coupler, or directly transmitted and received through the coupler. In this manner, only the cars' ends that are in close proximity to each other would be communicating. It may be possible that locomotive or car transceivers used for communication with track transceivers could also be properly placed to act as car-to-car proximity transceivers.

Locomotive-to-locomotive transmission is valuable to provide information about the status of all helper engines to the lead engine. This can provide more efficient bidirectional communication down the track to the train controller regarding the status of a consist without each helper locomotive having to share the limited bandwidth of the bi-directional track communication system to send its own information. Communication from locomotive to locomotive can also provide motor control information to help each engine more evenly share the pulling power.

The terms and descriptions used above are set forth by way of illustration only and are not meant as limitations. Those skilled in the art will recognize that many variations can be made to the details of the above-described embodiments without departing from the underlying principles of the invention. The scope of the invention should therefore be determined only by the following claims—and their equivalents—in which all terms are to be understood in their broadest reasonable sense unless otherwise indicated.

The invention claimed is:

1. A model railroad remote object comprising:

a proximity detector that changes state based on proximity of the detector to a proximity source;

an on-board accessory on or within the remote object, the on-board accessory exhibiting a behavior based on a parameter; and a processor operatively connected to the proximity detector and to the on-board accessory, wherein the processor has a current logical state and it affects a value of the parameter of the on-board accessory based on the state of the proximity detector in combination with the current logical state of the processor;

wherein the proximity detector is an IR detector, and the proximity source generates a modulated IR signal in which is embedded data concerning the parameter.

2. A model railroad remote object according to claim 1, wherein the remote object is selected from a group consisting of locomotives, train cars, and a caboose.

3. A model railroad remote object according to claim 1, wherein the proximity detector is selected from a group consisting of a reed switch and a Hall effect device.

4. A model railroad remote object according to claim 1, wherein the proximity detector is a light detector.

5. A model railroad remote object according to claim 1, wherein the processor generates a feedback response to the change of state of the proximity detector.

6. A model railroad remote object according to claim 1, wherein the on-board accessory is an audio device and the behavior is emission of sound, and the parameter is sound volume.

7. A model railroad remote object comprising:

a proximity detector that changes state based on proximity of the detector to a proximity source;

an on-board accessory on or within the remote object, the on-board accessory exhibiting a behavior based on a parameter;

a processor operatively connected to the proximity detector and the on-board accessory, wherein the processor affects a value of the parameter of the on-board accessory based on the state of the proximity detector; and wherein the accessory is an audio device and the behavior is emission of sound;

wherein a first application of the proximity source to the proximity detector increases a volume parameter of the sound based upon a length of time the proximity source remains within a proximity range of the proximity detector; and wherein a second application of the proximity source to the proximity detector decreases the volume parameter of the sound based upon the length of time the proximity source remains within the proximity range of the proximity detector.

8. A combination comprising:

an external proximity source; and a model railroad remote object having wheels for moving along a model railroad track, the remote object comprising:

an on-board processor that maintains a current logical state and controls operation of one or more aspects of the remote object; and a proximity detector located on or near a top side of the remote object such that the proximity detector detects whether the external proximity source is within a predetermined proximity of the proximity detector above or to a side of the remote object, wherein the proximity detector has an output indicative of a presence of the proximity source within the predetermined proximity, the output being operatively connected to the processor, and wherein the processor affects operation of the remote object in response to receipt of a signal indicative of the presence of the proximity source within the predetermined proximity in combination with the current logical state;

wherein the proximity source is portable and the onboard processor has at least a first logical state in which it responds to the signal indicative of the presence of the proximity source within the predetermined proximity by switching to a second logical state; and wherein the proximity source is a portable handheld device.

9. A combination according to claim 8, wherein the proximity source comprises a magnet, and the proximity detector is selected from a group consisting of a reed switch and a Hall effect device.

10. A combination according to claim 8, wherein the operation is resetting the remote object to default values in response to said signal when the first logical state is a power-off state.

11. A combination according to claim 8, wherein the accessory is a motor and the operation is activation or deactivation of the remote object.

12. A combination comprising:

an external proximity source; and a model railroad remote object having wheels for moving along a model railroad track, the remote object comprising:

an on-board processor that controls operation of one or more aspects of the remote object; and a proximity detector located on or near a top side of the remote object such that the proximity detector detects whether the external proximity source is within a predetermined proximity of the proximity detector above or to a side of the remote object, wherein the proximity detector has an output indicative of a presence of the proximity source within the predetermined proximity, the output being operatively connected to the processor, and wherein the processor affects the operation of the remote object in response to receipt of a signal indicative of the presence of the proximity source within the predetermined proximity; and further wherein the remote object is a locomotive in a consist, and the operation is selecting a helper type for the locomotive engine.

13. A combination according to claim 8, wherein operation is generation of a status report.

14. A combination according to claim 8, wherein the proximity source emits the signal in which is embedded information for controlling the operation of the remote object.

15. A model railroad remote object according to claim 8, wherein the remote object comprises an illumination device and the operation is emission of light from the illumination device.

16. A model railroad remote object according to claim 8, wherein the remote object comprises a coupler and the operation is opening or closing the coupler.

17. A model railroad remote object according to claim 8, wherein the remote object comprises an audio device and the operation is emission of sound from the audio device.

18. A model railroad remote object according to claim 17 wherein the operation comprises a simulated Doppler shift of the emission of sound.

19. A model railroad remote object comprising:

a proximity detector that changes state based on proximity of the detector to a proximity source;

one or more on-board accessories, on or within the remote object, capable of exhibiting one or more behaviors in response to commands;

an on-board processor operatively connected to the proximity detector and the one or more on-board accessories, the processor capable of generating the commands to induce the one or more behaviors in the one or more on-board accessories, wherein the processor generates one or more of said commands in response to a change of state of the proximity detector, and a selection of the one or more generated commands is based upon a state of the remote object sensed by the processor;

wherein the accessory is an audio device, the behavior is emission of sound, and the state of the remote object is a binary state for either volume increase or volume decrease for the sound; and wherein an extent of the volume increase or the volume decrease is based on a length of time the proximity source remains within a proximity range of the proximity detector, and wherein the binary state toggles between the volume increase and the volume decrease with each successive application of the proximity source with the proximity range of the proximity detector.

* * * * *